United States Patent [19]

Hansen et al.

[11] Patent Number: 4,669,681

[45] Date of Patent: Jun. 2, 1987

[54] CORD-DISPENSING SPOOL CADDIE

[75] Inventors: Robert R. Hansen, 1325 S. Beach Dr., Camano Island, Wash. 98292; David R. Wingsness, Seattle, Wash.

[73] Assignee: Robert R. Hansen, Camano Island, Wash.

[21] Appl. No.: 880,211

[22] Filed: Jun. 30, 1986

Related U.S. Application Data

[63] Continuation-in-part of Ser. No. 741,046, Jun. 4, 1985, abandoned.

[51] Int. Cl.[4] ..... B65H 49/14; B65H 49/36; B65H 49/38

[52] U.S. Cl. ..... 242/137.1; 242/129.5; 242/132; 242/137

[58] Field of Search ..... 242/129, 129.5, 129.6, 242/129.7, 129.8, 137.1, 138, 157 R, 157 C, 130, 132, 134, 137, 140, 141, 146

[56] References Cited

U.S. PATENT DOCUMENTS

| | | | |
|---|---|---|---|
| 193,033 | 7/1877 | Pierce | 242/137.1 |
| 1,147,694 | 7/1915 | Shearn | 242/137.1 |
| 2,110,588 | 3/1938 | Churn | 242/134 |
| 3,304,025 | 2/1967 | Zerg et al. | 242/129 |
| 3,771,743 | 11/1973 | DeLuca et al. | 242/129.8 |
| 4,563,965 | 1/1986 | Gregory | 242/157 R |

*Primary Examiner*—Donald Watkins
*Attorney, Agent, or Firm*—Robert W. Beach; Ward Brown

[57] ABSTRACT

A plurality of cord spool mounting spindles are arranged in parallel relationship in a planar row within an elongated case. The case has in it one or more dispensing ports through which cord can be dispensed from spools mounted on the spindles.

10 Claims, 16 Drawing Figures

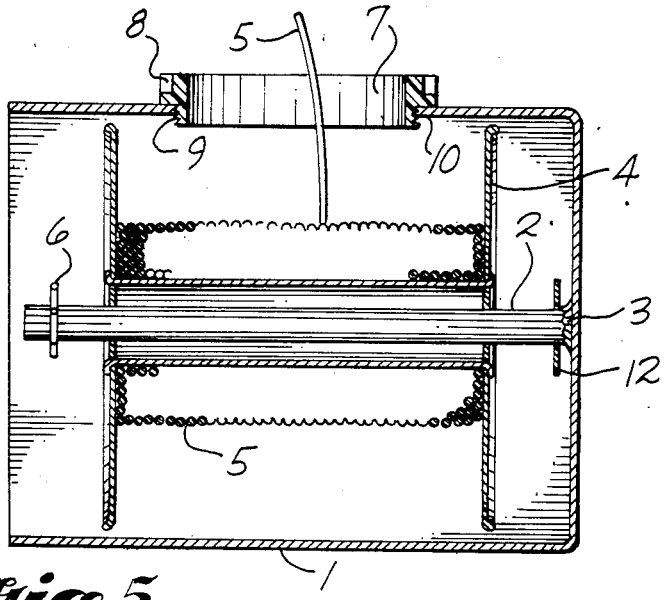
Fig. 5
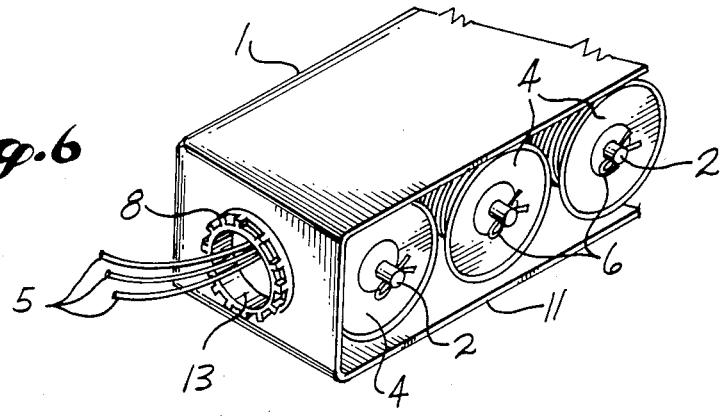
Fig. 6
Fig. 7
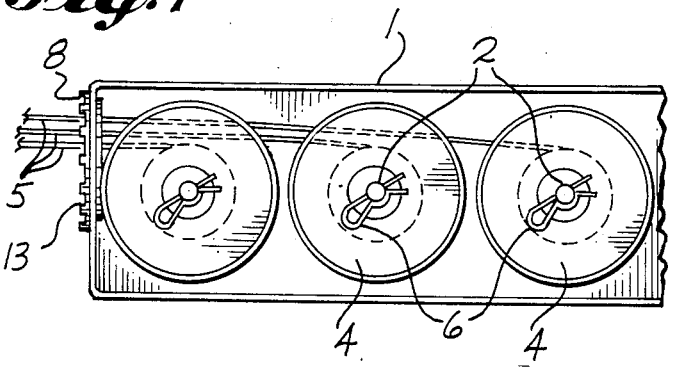

Fig. 8
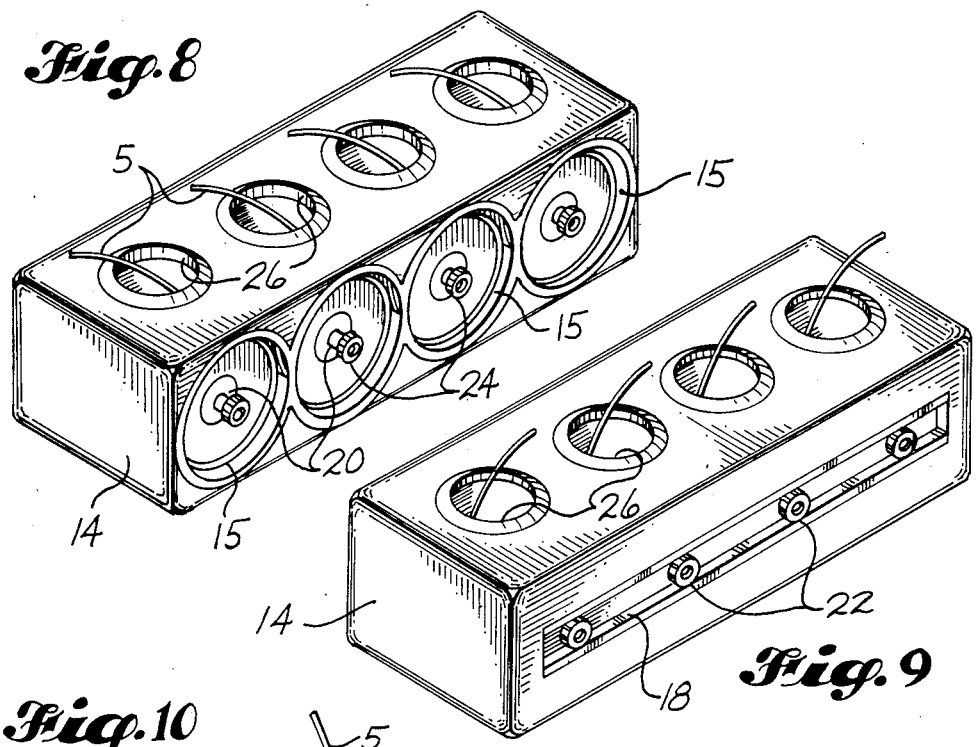
Fig. 9
Fig. 10
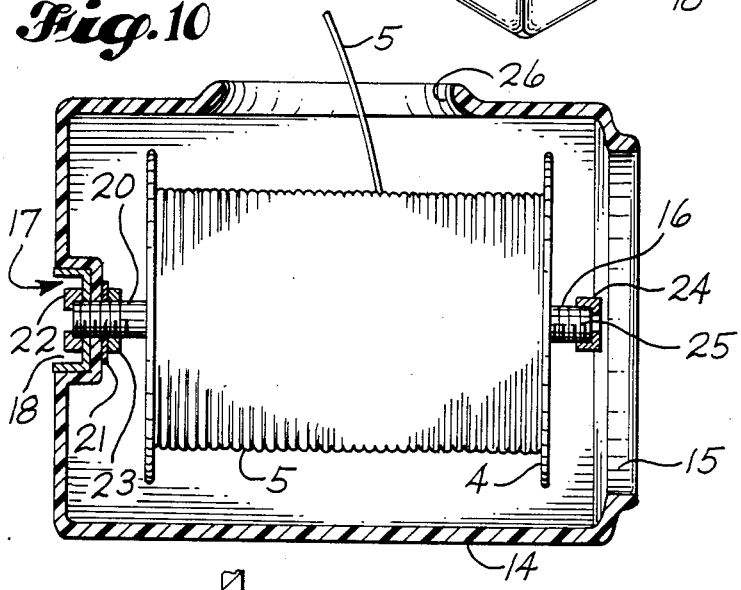
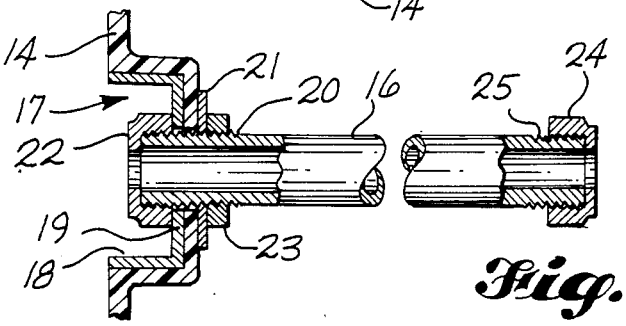
Fig. 11

CORD-DISPENSING SPOOL CADDIE

This application is a continuation-in-part of application Ser. No. 741,046, filed June 4, 1985, now abandoned, for Dispensing Spool Caddie.

BACKGROUND OF THE INVENTION

1. Field of the Invention

The present invention relates to a caddie for dispensing cord such as rather stiff but bendable wire, usually insulated, from a plurality of spools 2. Prior Art Previous practice has been to dispense cord such as rather stiff but bendable insulated wire from a plurality of individual spools which are not held relative to each other, or which are mounted individually on spindles from which cord can be dispensed without the spools being housed and without adequate provision for keeping the cords from the various spools separated to avoid entanglement.

SUMMARY OF THE INVENTION

A principal object of the invention is to provide a caddie which will contain a plurality of spools and organize them for convenient dispensing of cord from the spools.

Another object is to provide a caddie which can be designed to hold any desired number of spools.

Also it is an object to mount spools in the caddie case to facilitate dispensing from the case cord in the form of rather stiff but bendable wire carried by the spools.

An additional object is to enable the cord carried by a spool mounted in the caddie case to be arranged easily and quickly to be dispensed from the spool.

A further object is to provide a caddie for a plurality of spools in which any one or more of the spools can be removed and replaced easily and quickly without disturbing the other spools.

It is also an object to provide a spool caddie which is durable and rugged but which can be carried conveniently.

The foregoing objects can be accomplished by a dispensing spool caddie including an elongated case containing a substantially planar row of spindles disposed in parallel relationship for mounting individual spools, respectively, which case also has port means through which cords usually in the form of rather stiff but bendable wire can be dispensed from the respective spools.

BRIEF DESCRIPTION OF THE DRAWING

FIG. 5 is a section through the caddie taken on line 5—5 of FIG. 3.

FIG. 6 is a fragmentary top perspective of an alternative form of the caddie and FIG. 7 is a side elevation of the alternative form of caddie shown in FIG. 6.

FIG. 8 is a top perspective of a modified type of caddie and

FIG. 9 is a top perspective of such caddie viewed from the opposite side.

FIG. 10 is an enlarged transverse section through the caddie of FIGS. 8 and 9.

FIG. 11 is a fragmentary section of a portion of the caddie shown in FIG. 10 on an enlarged scale.

DETAILED DESCRIPTION

Figure 1:
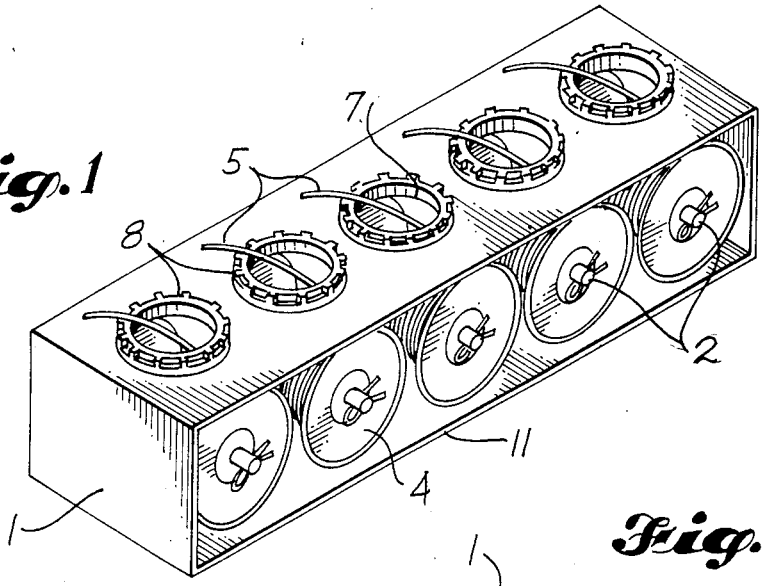
FIG. 1 is a top perspective of a dispensing spool caddie according to the present invention.
Figure 2:
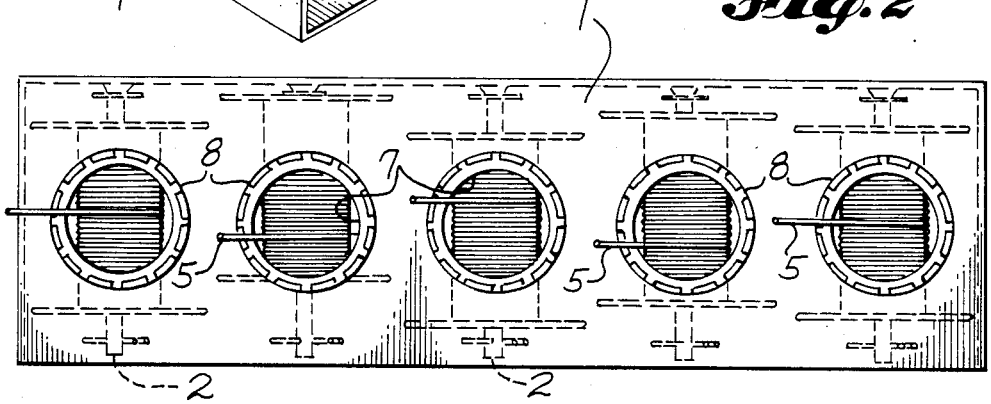
FIG. 2 is a plan of such caddie.
Figure 3:
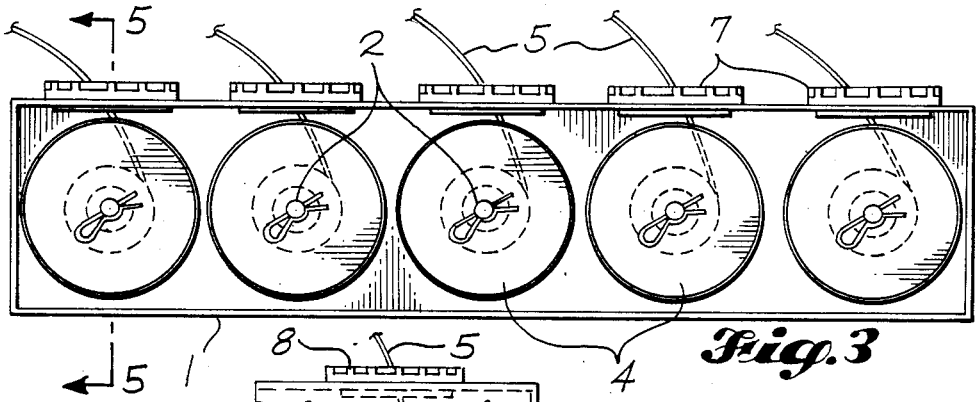
FIG. 3 is a side elevation of the caddie.
Figure 4:
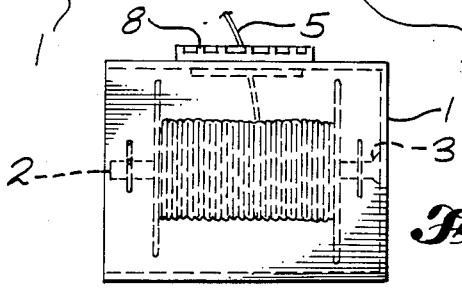
FIG. 4 is an end elevation of the caddie.

The purpose of the caddie of the present invention is to house spools in an organized fashion for dispensing conveniently cord carried by the spools. While the cord can be of various types, the caddie is particularly useful for housing spools carrying cord which is small gauge, rather stiff but bendable, insulated electric wire such as 10 gauge to 14 gauge. The electric wire cord may contain two, three or more conductors as long as it is sufficiently flexible to be stored conveniently on a small spool, such as having end flanges 4 inches to 8 inches in diameter. In any event, the cord is of long, slender, rather stiff, bendable structure roughly cylindrical, whether or not it is insulated electric wire.

The caddie shown in FIGS. 1 to 7, inclusive, includes an elongated case 1 housing a row of spindles 2 disposed in substantially coplanar parallel relationship spaced lengthwise of the case. Each spindle is mounted in the case by having one end anchored to the rear wall forming the closed side of the case. As shown in FIG. 5, the case 1 and spindles 2 are metal and one end of each spindle is anchored to the inner side of the case closing wall by a weld 3. A spool 4 carrying cord 5 is carried by and rotatively mounted on the spindle. The spool is retained on the spindle by means such as a cotter pin or linchpin 6 extending through an aperture in the outer end portion of the spindle remote from the supported end of the spindle.

A very large cord-dispensing port 7 having a diameter or width greater than the radius of the flanges of spool 4, as shown in FIG. 5, is provided in a side wall of the case 1 shown in FIGS. 1 to 5 opening transversely of the spindles 2 through which the cord 5 can extend from a spool 4 as shown in FIG. 5. The axes of the spindles are substantially horizontal when wire is being dispensed and the apertures 7 will be in the upper wall of the case. Preferably such port has a bushing 8 with a threaded skirt 9 that can be screwed into a complementally threaded aperture 10 in the wall of the case. The bushing is of smooth plastic material to minimize friction with cord 5 engaging the bushing at whatever angle the cord may extend radially or axially relative to the axis of the dispensing port. The cord may be pulled easily from each spool as it rotates on its spindle 2. Two or more cords can be dispensed at the same time if desired simply by pulling on them collectively.

The front side 11 of the case 1 opposite the closed rear wall on which the spindles 2 are mounted is open as shown in FIG. 1 to afford free access to the spindles 2 for mounting spools 4 on them or removing such spools from the spindles and case. In mounting a spool on a spindle a length of cord 5 can be unwound from the spool before it is mounted on its spindle and such cord end can be moved through the open front 11 of the case 1 into its interior and passed out through the dispensing port 7 corresponding to the spindle on which the spool is to be mounted. The spool can then be slid axially onto its spindle and into the case 1 and the cotter pin or linchpin 6 inserted through the hole in the spindle end to retain the spool on its spindle.

It is preferred that the portion of the spindle 2 be of a length between its base and the retaining cotter pin or linchpin 6 substantially greater than the axial extent of the spool 4 so that the spool can slide freely along the spindle as cord is unwound from various portions of the spool periphery. Inward movement of the spool can be limited by engagement of its inner end with a washer 12 mounted on the inner end portion of the spindle as shown in FIG. 5.

In the modified type of caddie shown in FIGS. 6 and 7, instead of individual dispensing ports being provided for each cord in one side of the case 1, one end of the elongated case has in it a single common dispensing port 13 through which cords 5 from all of the spools can extend simultaneously. In installing the several spools it is easier to install first the one farthest from the port 13 and thread the cords successively through the empty portion of the case between the successively last spool to be installed and the discharge port. The end portion of the cord from the very last spool is unwound before such spool is mounted on its spindle and slack is pulled in the other cords so that they can be laid over the last spool as it is being mounted on its spindle. Such single dispensing port 13 can also be formed by a bushing 8 of the type shown best in FIG. 5.

The cases 14 of the modified caddies shown in FIGS. 8 to 16 are made of molded plastic. In the instance of FIGS. 8 to 11, instead of the elongated case having one elongated side completely open a plurality of apertures 15 are provided for enabling individual spools to be inserted respectively into the case 14 and mounted on their respective spindles 16.

The spindles 16 are mounted in cantilever fashion by attaching corresponding ends to the wall of the case 14 remote from the spool-receiving openings 15. Such wall has in it an outwardly-opening trough 17 lined with a reinforcing metal anchor bar 18 of channel cross section as shown in FIGS. 9, 10 and 11. Such channel and the bottom of trough 17 have apertures 19 in them to receive the threaded ends 20 of pipes forming the spindles 16. A washer 21 may be provided on each spindle at the inner side of the plastic wall of case 14 to reinforce it further and the threaded end 20 of the pipe spindle is secured in place on the channel 18 and case wall between a lock nut 22 and a bushing 23 screwed onto the outer end of the pipe thread. Lock nut 22 is tightened against the washer 21 to clamp tightly together such washer, the margin of the aperture through the plastic, the reinforcing channel 18 and the bushing 23. A bushing 24 can be screwed onto the other free threaded end 25 of the pipe spindle to retain a spool 4 on the spindle.

The spools 4 and cords 5 can be installed in the modified caddie shown in FIGS. 8 to 11 in the same manner as described in connection with the caddie shown in FIGS. 1 to 5 inclusive.

Figure 12:
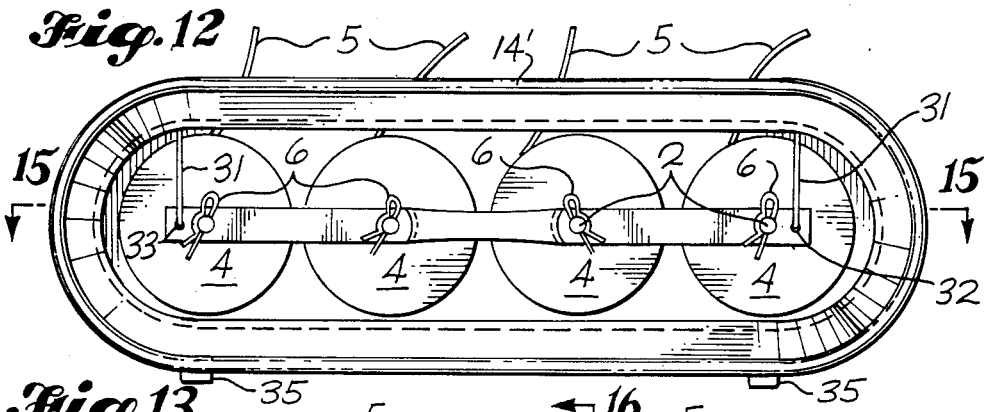
FIG. 12 is a front elevation of a further modified type of caddie.

The plastic case 14' of the further modified caddie shown in FIGS. 12 to 16 has end portions rounded generally concentrically with the spindles 2 for the end spools as shown in FIG. 12. This case also has a groove 17 in its rear wall in which is received a metal reinforcing bar 18'. In this instance, as shown best in FIGS. 15 and 16, the reinforcing bar is shown as being of flat bar stock instead of being of channel cross section like the reinforcing bar 18 shown in FIGS. 9 to 11, but, if desired, such reinforcing bar could also be of angle or channel cross section.

The reinforcing bar 18' has through it apertures spaced lengthwise of the bar corresponding to the desired spacing of the spindles 2. The bottom of the groove 17 has apertures through it corresponding to the locations of the apertures in the reinforcing bar 18'. As in the other types of caddie described above, the spindles are of cantilever type and their supported ends extend through the apertures in the bottom of groove 17 and the corresponding apertures in the reinforcing bar 18'. The supported ends of the spindle rods 2 can be reduced to form a shoulder bearing against the inner margins of the apertures in the bottom of the trough 17, and the reduced end portions of the spindles can be threaded to receive retaining nuts 27 that can be tightened to clamp the bottom of the trough 17 and the reinforcing bar 18' between such nuts and the shoulders of the spindles 2. Alternatively, the ends of the spindle reduced end portions projecting through reinforcing bar 18' can be upset or welded to the reinforcing bar to secure the spindles permanently in place in the case 14'.

As described in connection with the caddie shown in FIGS. 1 to 5, inclusive, the spools 4 can be moved through the open side 11' of the caddie case opposite the trough 17 and placed on the respective spindles 2. The spools can be held on such spindles by cotter pins or linchpins 6 extending through transverse holes in the outer end portions of the spindles.

In order to facilitate rotation of the spools 4 on the spindles 2, large thrust washers 27, preferably of plastic material, can be placed on the spindles between the inner ends of the spools and the internal elongated ridge of the plastic case forming the trough 17.

Figure 13:
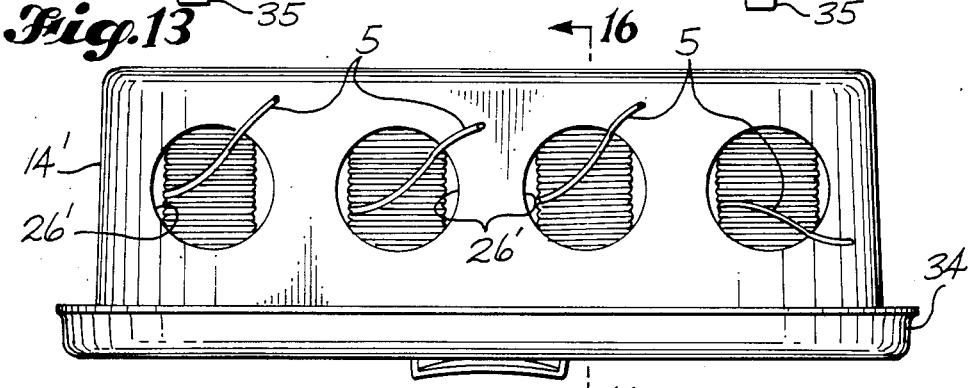
FIG. 13 is a plan of such caddie.

In the modifications of the caddie shown in FIGS. 8 to 16 the dispensing ports 26 of FIGS. 8 to 11 and ports 26' of FIGS. 12 to 16 are arranged like the dispensing ports 7 shown in FIG. 1 but it is not necessary to provide bushings for such ports because the plastic of the case will form smooth lips for the ports over which the cords 5 can be drawn without injury and with little frictional resistance. The margins of such ports can be flared outward somewhat as shown for the ports 26 in FIG. 10. In both the caddies of FIGS. 8 to 11 and FIGS. 12 to 16 the dispensing ports 26 and 26', respectively, are very large, exceeding in diameter the radius of the flanges of the spools 4, and the dispensing ports are located transversely of the spindles 2 in one side of the case 14 or 14', as shown in FIGS. 8, 9 and 13. Consequently, the cords, even though they are rather stiff but bendable wire, can be withdrawn readily from the spools in any direction including radially or axially of the dispensing ports. In order to prevent the cords from being caught between a spool flange and the inner side of the case wall, it is preferred that the clearance between the spool flange and the inner side of the case wall having the dispensing ports be less than the thickness of the cord being dispensed.

Figure 15:
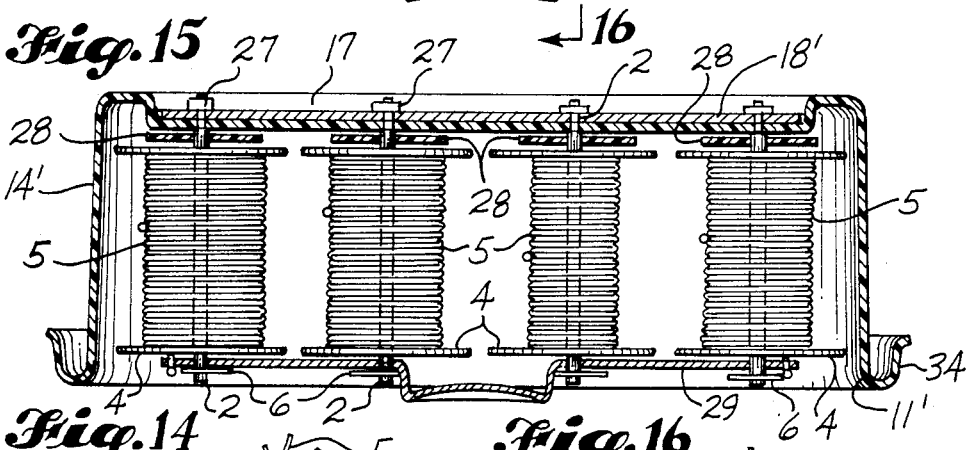
FIG. 15 is a longitudinal section through the further modified caddie taken on line 15—15 of FIG. 12.

To reduce the stress on the root ends of the spindles 2, the outer ends of such spindles can be interconnected by a connecting bar 29 as shown in FIGS. 12 and 15. Such connecting bar has through it apertures to receive the outer ends of the spindles so that the bar can be lodged between the outer flanges of the spools 4 and the cotter pins or linchpins 6. Also the central portion of the connecting bar 29 can be offset outward away from the back wall of the case to form a handle 30 that can be grasped for carrying the caddie with its open side up and its closed side having the trough 17 at the bottom.

Figure 14:
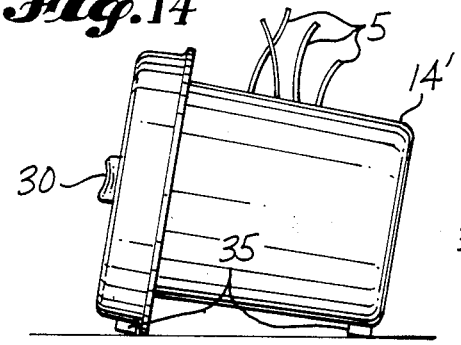
FIG. 14 is an end elevation of such caddie.

Weight of the wire spools 4 can be transmitted to the case not only through the root ends of the cantilever spindles 2, but also from the outer ends of such spindles through the connecting bar 29 by suspending such connecting bar from the upper side of the case 14' as shown in FIGS. 12 and 14, by suspending ties 31 having their upper ends 32 extending through the upper wall of the case and anchored relative to the case, while their lower ends 33 extend through apertures in the opposite end portions of the connecting bar 29 and are anchored to it.

The closed principal side of the case 14' having the trough 17 in it being integral with one edge of the peripheral wall of the case stiffens such edge. The edge of the peripheral wall forming the case opening 11' can be stiffened by forming integral with it a return bent external reinforcing flange 34.

Figure 16:
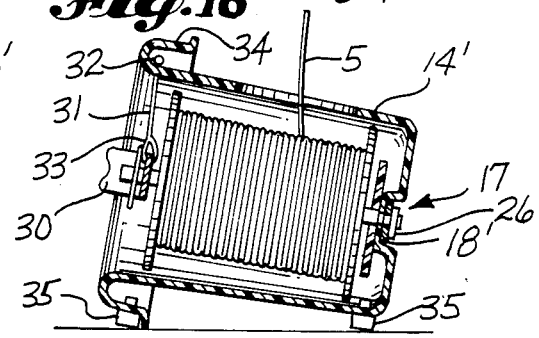
FIG. 16 is a transverse section through such caddie taken on line 16—16 of FIG. 13.

Sliding of the case relative to the surface on which it rests can be deterred by supporting the case on antifriction feet 35 carried by the walls of the case as shown in FIGS. 12, 14 and 16.

We claim:

1. A cord-dispensing spool caddy comprising an elongated case having an elongated wall closing the back of said case, a plurality of cord spool mounting spindles received within said case and arranged in a row in generally parallel relationship for mounting flanged spools on said spindles, said spindles having corresponding ends anchored to said elongated wall, and a cord-dispensing port in said case opening transversely of the length of said spindles and of a width at least as great as the radius of the flanges of spools for dispensing from said case cord wound on spools mounted on said spindles.

2. The caddie defined in claim 1, in which the port means includes a number of ports equal to the number of spindles for dispensing cord from spools mounted on the respective spindles, each of said ports being of a width at least as great as the radius of a flange of one of the spools.

3. The caddie defined in claim 2, the ports being located respectively generally in registration with the respective spindles.

4. The caddie defined in claim 1, in which the cord-dispensing port is located at an end of the row of spindles.

5. The caddie defined in claim 1, in which the spindles are mounted in cantilever fashion on the back wall of the case, and each spindle is of a length substantially exceeding the axial extent of a spool to be mounted thereon

6. The caddie defined in claim 1, in which each spindle is a pipe mounted in cantilever fashion on the back wall of the case, and a bushing mounted on the free end of the spindle for retaining a spool thereon.

7. The caddie defined in claim 1, in which the case is made of plastic material and has a plurality of spool-receiving apertures arranged in a row along its side opposite the back wall of the case and in registration with the spindles respectively.

8. The caddie defined in claim 1, in which the case is made of plastic material, and the back wall has an outwardly opening trough extending lengthwise thereof and an anchor bar received in said trough, corresponding ends of the spindles extending through apertures in the back wall of the case and being anchored to said anchor bar.

9. The caddie defined in claim 8, and a connecting bar connecting the ends of the spindles remote from the back wall of the case, said connecting bar including a central portion offset from the remainder of the connecting bar outward in the direction away from the back wall of the case for forming a carrying handle.

10. The caddie defined in claim 8, and suspension means connecting the connecting bar and a portion of the wall of the case above the connecting bar for supporting the connecting bar from the case.

* * * * *